US009134004B2

(12) United States Patent
Wacholder et al.

(10) Patent No.: US 9,134,004 B2
(45) Date of Patent: Sep. 15, 2015

(54) LIGHTING SYSTEM FOR ART WORKS

(75) Inventors: Daniel Wacholder, Laguna Beach, CA (US); Herbert E. Seymour, Los Angeles, CA (US)

(73) Assignee: Cerno LLC, Irvine, CA (US)

( * ) Notice: Subject to any disclaimer, the term of this patent is extended or adjusted under 35 U.S.C. 154(b) by 191 days.

(21) Appl. No.: 13/457,951

(22) Filed: Apr. 27, 2012

(65) Prior Publication Data

US 2013/0286649 A1 Oct. 31, 2013

(51) Int. Cl.

| | |
|---|---|
| ***F21V 13/04*** | (2006.01) |
| ***F21V 5/00*** | (2015.01) |
| ***F21S 4/00*** | (2006.01) |
| *F21W 131/304* | (2006.01) |
| *F21Y 101/02* | (2006.01) |
| *F21Y 103/00* | (2006.01) |

(52) U.S. Cl.

CPC . *F21V 5/00* (2013.01); *F21S 4/008* (2013.01); *F21V 13/04* (2013.01); *F21W 2131/304* (2013.01); *F21Y 2101/02* (2013.01); *F21Y 2103/003* (2013.01)

(58) Field of Classification Search

USPC ..... 362/231, 235

See application file for complete search history.

(56) References Cited

U.S. PATENT DOCUMENTS

| | | | | |
|---|---|---|---|---|
| 3,492,474 | A * | 1/1970 | Hishinuma et al. | 362/350 |
| 4,689,547 | A | 8/1987 | Rowan et al. | |
| 4,716,344 | A | 12/1987 | Newell et al. | |
| 4,727,296 | A | 2/1988 | Zaharchuk et al. | |
| 4,745,351 | A | 5/1988 | Rowen et al. | |
| 4,792,731 | A | 12/1988 | Pearlman et al. | |
| 5,072,216 | A | 12/1991 | Grange | |
| 5,491,463 | A | 2/1996 | Sargeant et al. | |
| 5,526,245 | A | 6/1996 | Davis et al. | |
| 5,903,226 | A | 5/1999 | Suman et al. | |
| 6,175,201 | B1 | 1/2001 | Sid | |
| 6,331,813 | B1 | 12/2001 | Belliveau | |
| 6,369,524 | B1 | 4/2002 | Sid | |
| 7,070,293 | B2 | 7/2006 | Seymour | |
| 7,553,051 | B2 * | 6/2009 | Brass et al. | 362/373 |
| 2003/0002285 | A1 | 1/2003 | Paravantos | |
| 2006/0018112 | A1 * | 1/2006 | Seymour | 362/147 |
| 2006/0023465 | A1 * | 2/2006 | Ohshio et al. | 362/514 |
| 2007/0076412 | A1 * | 4/2007 | Harbers et al. | 362/231 |
| 2009/0129072 | A1 * | 5/2009 | Oza | 362/231 |
| 2009/0168422 | A1 * | 7/2009 | Chiu et al. | 362/249.03 |
| 2009/0290344 | A1 * | 11/2009 | Chiang et al. | 362/240 |
| 2010/0079059 | A1 * | 4/2010 | Roberts et al. | 313/503 |

(Continued)

FOREIGN PATENT DOCUMENTS

| | | | |
|---|---|---|---|
| JP | 2005-243522 | A | 9/2005 |
| JP | 2006-324134 | A | 11/2006 |

(Continued)

*Primary Examiner* — Sikha Roy

(74) *Attorney, Agent, or Firm* — Jeffrey M. Hersh

(57) ABSTRACT

A lighting system and process for lighting objects particularly art works such as paintings and sculptures, comprising a diffusing film that scatters the light such that the object is illuminated substantially uniformly. The preferred embodiment employs one row of such lighting sources for small objects, and two or more rows for larger objects. The inner row is directed towards the top portion of the object and the outer row is directed towards the bottom portion of the object. The rows need not be placed next to each other. For 3-dimensional objects, one row may be below the object and the other row above to eliminate shadows.

20 Claims, 4 Drawing Sheets

(56) References Cited

U.S. PATENT DOCUMENTS

2010/0238658 A1* 9/2010 Xiang et al. ..... 362/235
2012/0275167 A1* 11/2012 Scruggs et al. ..... 362/296.08

FOREIGN PATENT DOCUMENTS

KR 10-0880429 B1 1/2009
KR 10-1109142 B1 2/2012

* cited by examiner

LIGHTING SYSTEM FOR ART WORKS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates generally to the field of lighting systems, and more particularly to a 1- or multi-array of lights with each row having different intensities, different angles, different secondary optics, and different diffusion films to scatter the light towards an object—typically an art work—to achieve substantially uniform lighting of the object.

2. Background Art

Paintings, sculptures and other art works are typically illuminated by one or more lights directed generally towards the center of the art work. This causes a hot spot of intense light at that area, and increasingly dimmer lighting towards the periphery of the work. This greatly detracts from the aesthetic perception and enjoyment of the art work.

Some adjustable multi-light arrays improve this deficiency, but they still create two or more hot spots, leaving non-uniform lighting of the art work. Lights are typically placed immediately above the art work, or in the ceiling, leaving the top portion of the work significantly brighter than the bottom portion due to attenuation and disbursement of the light over a greater distance towards the bottom, along with greater intensity in the center of the horizontal axis than at the sides.

One device disclosed in U.S. Pat. No. 7,070,293 B2 shows a 2- to 3-row overhead array of lights spanning the width of the art work in which each row of lights has a different intensity and angle towards the art work. One row is aimed towards the top portion of the art work having lower intensity than the row (or rows) angled towards the lower portion or portions of the art work. One embodiment shows the use of optical attenuators to provide a relatively even gradient of light from the top to the bottom of the art work, away from the light feature.

Attenuators, however, are inefficient as they block a portion of the light, requiring greater intensity of light. They work by either absorbing the light, or reflecting it back towards the light source, where it is dissipated. Graduated attenuators, such as a Benday screen, are suggested in the '293 patent to block a greater amount of light that is aimed at the top-most portion of the art work, and less light as the angle moves down the art work. Benday screens are comprised of opaque dots on a transparent film, with a greater density of dots positioned on the screen in the areas greater attenuation is desired. In practice, such attenuators have produced a somewhat uniform lighting system, but fail short of producing a uniform light.

It would be beneficial to have a system for directing and disbursing the light without the use of attenuators such that the art work is uniformly lit, and one that is inexpensive to make. It would be further beneficial to have a small, unobtrusive fixture to illuminate the art work.

BRIEF SUMMARY OF THE INVENTION

The present invention solves these problems by using a diffusing film to scatter the light directed towards an object, typically an art work. Diffusing film is comprised of a thin piece of material—typically plastic—that scatters light as it passes through it. Specialized films can diffuse light in a specified manner, such as 5 degrees, or 30 degrees, enabling the light to be disbursed in an even and controlled fashion even with multiple light sources.

In the preferred embodiment, for small art works—about 16 inches in height or less—one row of lights spanning the width of the art work is sufficient to light it evenly so that human eye cannot detect differences in intensity over the vast majority of the art work. The threshold for avoiding human detection of different illumination levels is within about 50 percent intensity throughout the art work.

For larger art works, two rows of lights are positioned atop the art work—typically a painting—generally spanning the width of the art work. The inner-most row, or first module, is directed towards the top portion of the art work, and the outer row, or second module, is directed further down the art work. The light sources are preferably light-emitting diodes ("LEDs").

The light sources on inner-most row—which is designated as module one or the first module—are focused by parabolic reflectors and directed towards the art work. Parabolic reflectors create a secondary ring of more intense light around the central hot spot generated by the light source. Diffusers take advantage of this phenomenon to scatter the light in a more uniform manner. Diffusers may also be used to scatter the light horizontally, thereby avoiding the need to have a continuous row of lights extend completely across the horizontal length of the art work.

The outer-most row of lights (module two) preferably has total internal reflection (TIR) lenses instead of parabolic reflectors, which are larger, less efficient and more costly than TIR lenses. Because of the greater distance from the targeted area of illumination, the light need not be scattered with as much of a scattering effect as with the inner-most row of lights (module one). In other words, module two does not require the benefits from the secondary ring effect because of it has a smaller angle of its propagation field due to its greater distance from the light source.

Diffusing films are preferably used for each module. Diffusing films comprise a thin film having a texture embossed on the film to scatter the light. In one embodiment, embossed diffusing film is used, which is also known as holographic diffusing film.

In a single-module configuration for art works no more than 16 inches high, the module may be pivoted along the horizontal axis to provide the user control to aim the light onto the art work. A dimmer switch is also used to adjust the intensity of the light. In a two-module configuration, each module may independently pivot along the horizontal axis, with each module including a dimmer switch to independently adjust the intensity of the light. The ability to adjust the angle and intensity of each module enables the user to tailor the lighting system to the particularly sized art work to ensure substantially uniform light at the desired illumination level. In addition, a "global" dimming feature is provide to allow the entire fixture (both modules) to be dimmed and turned on and off in unison.

BRIEF DESCRIPTION OF THE SEVERAL VIEWS OF THE DRAWINGS

The accompanying drawings illustrate the invention, where like reference numerals indicate the same feature throughout the drawings.

DETAILED DESCRIPTION OF THE INVENTION

1. Definitions

Figure 1:
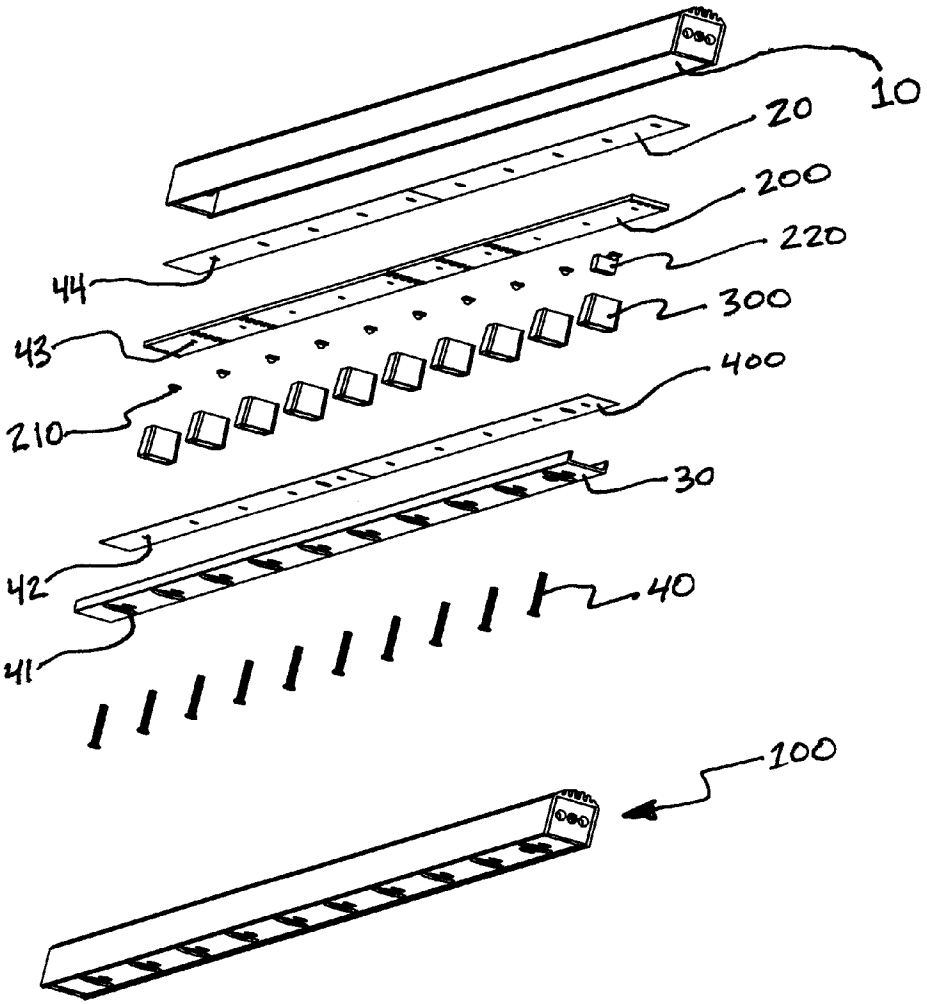
FIG. 1 shows an exploded view of a generic module of the present invention, along with the module itself.

In this specification and the claims that follow, the phrases "illuminated substantially uniformly" and "illuminating the object substantially uniformly," and like designations, shall mean to illuminate an object such that the art work or other object is illuminated sufficiently uniformly that, for at least 75 percent of the front surface of the object, the human eye cannot reasonably detect a difference in illumination intensity from one point on the art work or object to another point.

The human eye cannot typically dissociate between illumination intensity unless the intensity exceeds about 50 percent difference from one area to another. Consequently, "illuminated substantially uniformly" and "illuminating the object substantially uniformly" shall mean up to about 50 percent difference in illumination intensity, with the actual percentage being the amount in which an average person cannot dissociate between the illumination intensity from one area to another over at least 75 percent of the surface of the object. The "about 50 percent" shall be no less than 50 percent difference in illumination intensity, but no greater than the percent difference that an average person cannot detect a difference in illumination level with the naked eye.

For the portion of the art work that is not illuminated within this about 50 percent difference, that is, less than 25 percent of the art work, for an object "illuminated substantially uniformly," the illumination intensity of any particular area shall not differ by more than 100 percent of the average illumination level of the first area (the first area being the portion of the art work that has an illumination level within about 50 percent difference). In all of these cases, the percent difference shall be calculated by the percent increase of the lower or lowest illumination level.

In this specification and the claims that follow, the phrase "an object" or "the object" shall mean either a single object or a plurality of objects that collectively are generally adjacent or in proximity to each other, such that the collection of objects can be deemed a single entity comprised of individual objects. (For example, an object may comprise two distinct paintings adjacent to each other, or a multi-piece sculpture.) The phrase "an object" or "the object" shall also be limited to an object, or collection of distinct objects, that are at least nine inches (9") in the dimension orthogonal to the light fixture.

In this specification and the claims that follow, the word "height" refers to the dimension along the side of the object or art work that is in the line of sight of a viewer and is perpendicular to the longitudinal axis of the row of light sources; that is, it is in the direction that the light is projected across the object or art work. The terms "width" and "side" is the dimension parallel to the longitudinal axis of the row of light sources, and perpendicular to the "height" of the object or art work.

2. Preferred Embodiment

The drawings are for illustrative purposes of the preferred embodiment of the present invention, shown for a painting. The same design characteristics apply to other art works—such as a sculpture—and to any object for which one desires uniform lighting, such as historical or valuable documents. The substitution of various objects would be obvious to one ordinarily skilled in the art.

In FIG. 1, a single generic module is shown along with its housing. Generic module 100 is shown in its configured state at the bottom of the drawing, and an exploded view showing the various internal layers, housing and hardware is shown above. Housing 10 is at the top of generic module 100, and serves both as a top housing structure and a heat sink to dissipate heat generated by light-emitting diodes 210 ("LED 210"). Thermally conductive pad 20 is located immediately below housing 10 to provide electrical isolation and facilitate the transfer of heat to housing 10. A plurality of holes 44 are positioned to line up with fasteners 40, which screw into threaded holes in housing 10 (not shown in the drawings) to hold the various layers of generic module 100 together. Holes 44 are in-line with holes 41, 42, 43 on various other layers such that fasteners 40 may be inserted.

Circuit board 200 is positioned immediately below thermally conductive pad 20. Circuit board 200 is comprised of driver electronics, local dimming control 220, and a plurality of LEDs 210. Dimming control 220, which controls the illumination intensity of LEDs 210, is positioned on one side of circuit board 200. Holes 43 are present in circuit board 200 through which fasteners 40 extend. In the preferred embodiment, high brightness, surface mount, high color rendering, white LEDs are used. Circuit board 200 and dimmer switch 220 are well known to those skilled in the art.

LEDs 210 are inserted into secondary optics 300, which reflect the light generated by LEDs 210 in the general direction opposite housing 10. Such secondary optics 300 are well known in the art. In first module 110, which is directed towards the top portion of the painting, secondary optics 300 are preferably parabolic reflectors. Parabolic reflectors take advantage of the phenomenon that they create a secondary ring of intense light a radial distance from and around the central hot spot generated by the light source. In second module 120, which is directed towards the bottom portion of the painting, secondary optics 300 are preferably total internal reflection (TIR) lenses.

Below secondary optics 300 is diffusing film 400, which is a thin film that scatters light in a controlled manner as the light passes through it. Diffusing films comprise a thin film having a texture embossed on the film to scatter the light. In one embodiment, embossed diffusing film is used, which is also known as holographic diffusing film. Other types of diffusing film may also scatter the light sufficiently, such as a proprietary diffusing film disclosed at http://www.fusionoptix.com/ products/materials/diffusion.htm. Holes 42 are positioned on diffusing film 400 in line with fasteners 40.

The assembly described above is housed beneath by cover 30, which has holes 41 in line with fasteners 40. Cover 30 is secured to housing 10 by fasteners 40, which extend through holes 41, 42, 43, 44 and is attached to threaded holes in housing 10. Other forms of securing cover 30 to housing 10 may alternately be used.

The result of the above components so assembled forms generic module 100, which is shown at the bottom of FIG. 1. First and second modules 110, 120 are identical except that optics 300 are parabolic reflectors in first module 110 and total internal reflective lenses in second module 120, and diffusing film 400 has a larger angle of diffusion than the diffusing film in second module 120. Alternately, other types of optics and diffusing film may be used for either module.

Figure 2:
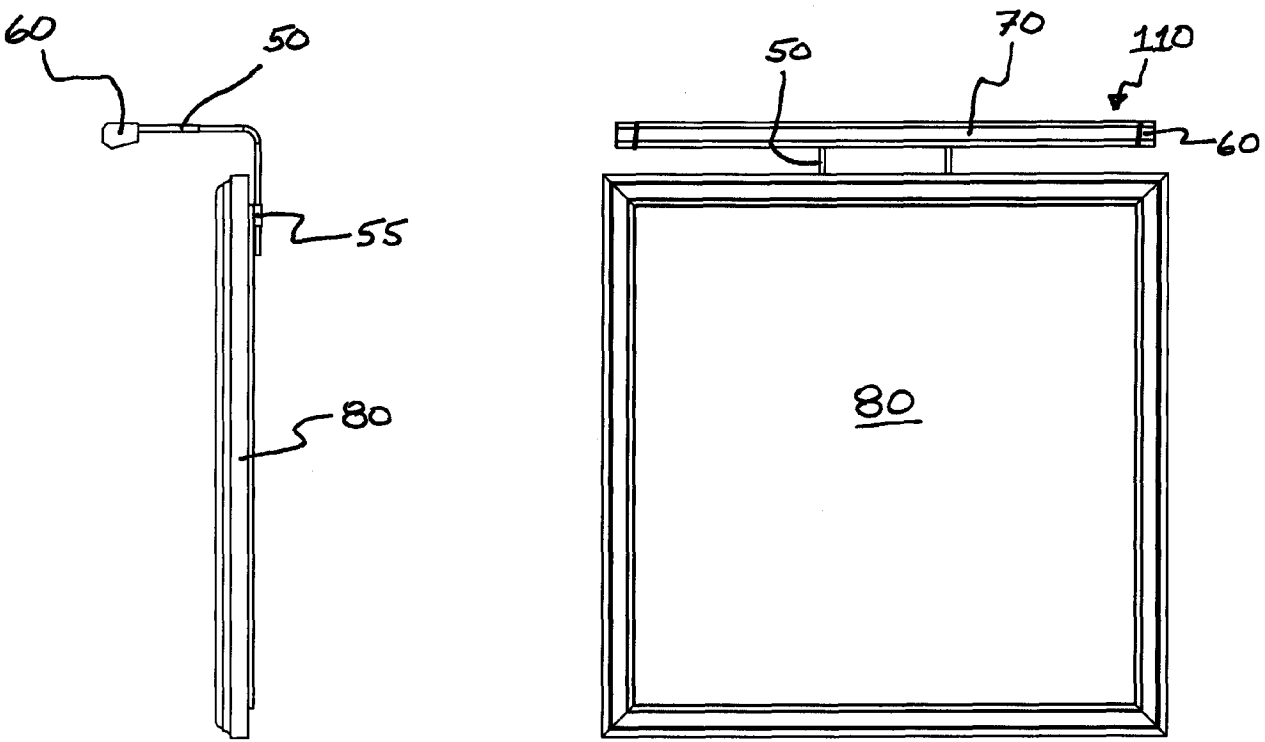
FIG. 2 shows a side and center view of the lighting system as assembled on the top portion of a painting.

As shown in FIG. 2, for a one-row assembly for use with small paintings, only first module 110 is used. It is housed in module housing 70, shown in FIG. 2. End caps 60 are secured on both ends of housing 70. First module 110 is mounted to end caps 60 such that it may pivot along the longitudinal axis, that is, horizontally, to enable the user to aim first module 110 onto painting 80 so that it lights the entire surface. Module housing 70 is attached to assembly 50, which is secured to painting 80 by adjustable brackets 55, which allows the assembly to be raised and lowered by the user.

Figure 3:
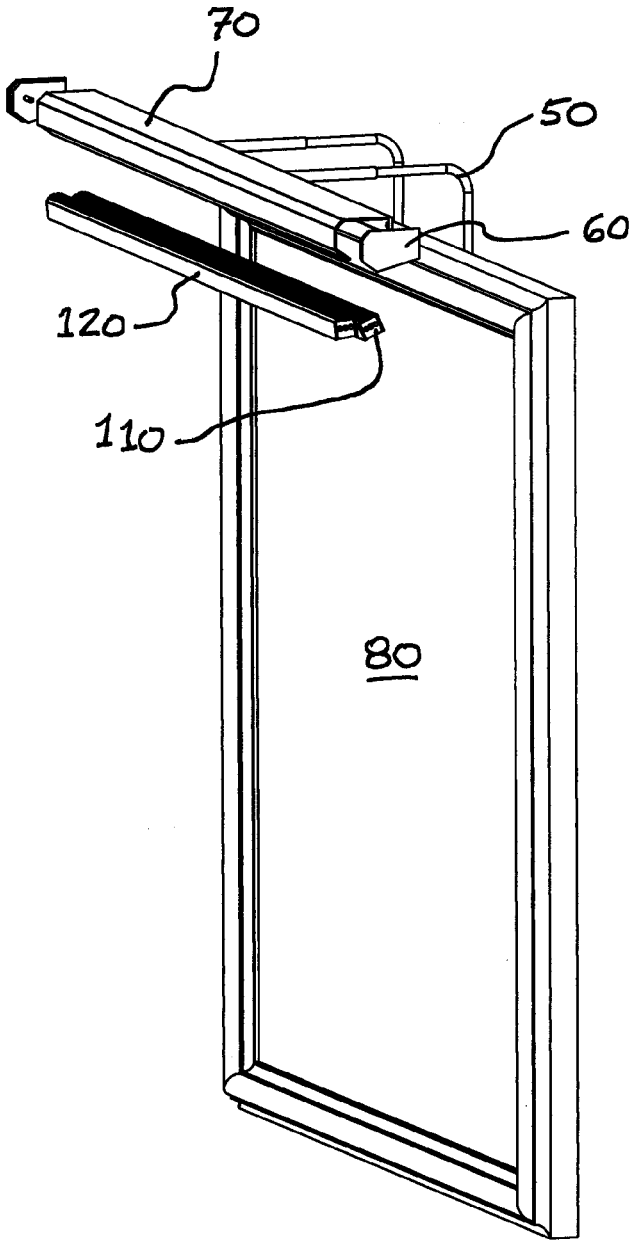
FIG. 3 shows a 3-dimensional view of the lighting system attached to a painting with the two modules removed to show the relative angles of each module.
Figure 4:
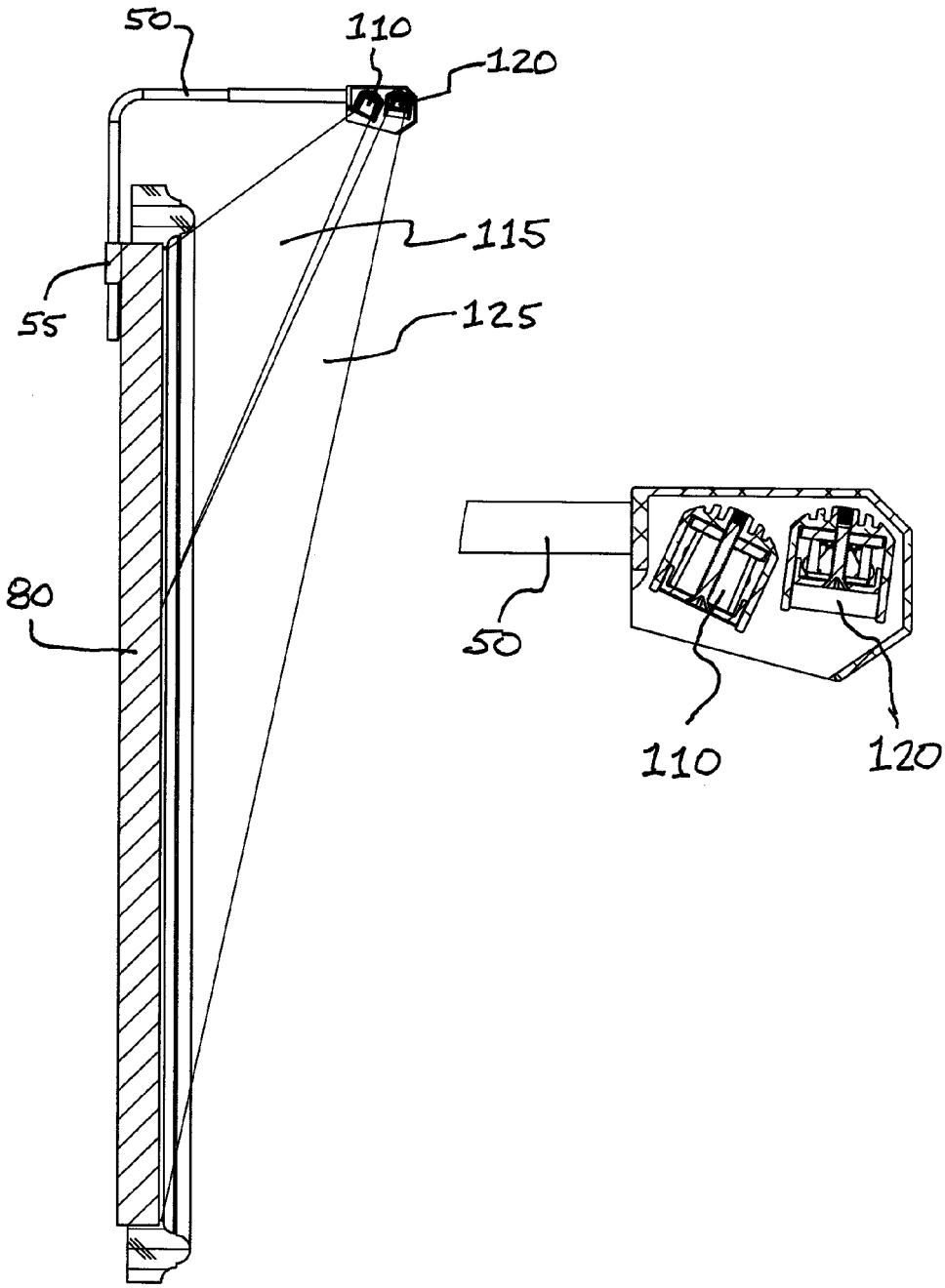
FIG. 4 shows a side view of the lighting system as assembled on the top portion of a painting along with the angle of projection and the portion of the painting illuminated by each module.

As shown in FIGS. 3 and 4, for a two-row assembly first module 110 and second module 120 are employed. They are housed in module housing 70. (FIG. 3 shows modules 110, 120 removed from module housing 70 to better illustrate the relative longitudinal angle between each of modules 110, 120; and FIG. 4 shows modules 110, 120 inside housing 70, with an enlargement of the modules.) Each of first module 110 and second module 120 are mounted to end caps 60 such that they may independently pivot along the longitudinal axis, that is, horizontally, to enable the user to aim the light onto painting 80. When properly orientated, or angled, first module 110 projects light from LEDs 210 onto painting 80 in propagation field 115, and second module 120 projects light from its LEDs 210 onto painting 80 in propagation field 125. Note that each module 110, 120 should be angled such that propagation fields 115, 125 have minimal to no overlap, that is, the lower boundary of propagation field 115 is substantially in the same location as the top boundary of propagation field 125.

The width of modules 110, 120 (along the longitudinal or horizontal axis) is preferably the width of painting 80, but may be less than the width if diffusing film 400 is designed to scatter the light horizontally outward onto painting 80 from the outer-most LEDs 210.

While the preferred embodiments shown in the various drawings depict one- and two-module lighting fixtures, three or may be used for a particularly tall object or art work. In such event, module two would be used for the third module, which would project light farther away from the lighting fixture than the first and second modules. In such event, the third and any subsequent modules for the preferred embodiment, the TIR lenses would be employed for optics 300.

Alternately, a one- or two-module lighting fixture may be positioned on each of the top and bottom of the object or art work, or on each side. For configurations with two one-module fixtures positioned opposite each other, in the preferred embodiment, parabolic reflectors would be used. For configurations with one or two two-module fixtures positioned opposite each other—such as for use in a relatively tall art work—parabolic reflectors would preferably be used for the first module, and where a two-module fixture is used, TIR lenses would preferably be used for the second module.

The one- and two-module lighting fixtures are also shown being attached to the object itself, but may instead be mounted directly to a wall or on the ceiling or floor, and may be located many feet from the object that it illuminates.

The two-module configuration may instead be placed in a single module having two sets of LEDs, where each set is directed at a different angle of propagation towards the object, typically in an alternating fashion. For multi-module configurations, one or more modules may have two such sets of LEDs.

For any configuration, the light sources need not be LEDs, but other conventional light sources, or any light source that may later be conceived.

Various other modifications may be made to that depicted in the various drawings of the preferred embodiment of the present invention without departing from the spirit and scope of the invention. Accordingly, the invention is not to be limited by the preferred embodiment shown in the various drawings and described herein, but by the scope of the claims.

The invention claimed is:

1. A lighting system for illuminating an object comprising:

a first and second row of light sources, each row having at least one light source that generates light, and each row positioned outside the line of sight of an object, with each light source in the first and second row of light sources being directed towards a viewing side of the object; and a first set of optics positioned between the first row of light sources and the object; and a second set of optics positioned between the second row of light sources and the viewing side of the object and having different optical properties than the first set of optics;

wherein the first set of optics scatters the light generated by the first row of light sources and directs it towards a first portion of the viewing side of the object, and the second set of optics scatters the light generated by the second row of light sources and directs it towards a second portion of the viewing side of the object that is farther away from the first and second rows of light sources than that of the first portion of the object, such that the first and second rows of light sources are capable of illuminating the viewing side of the object substantially uniformly.

2. The lighting system for illuminating an object of claim 1 in which the first and second rows of light sources are affixed to a fixture that is mounted to the object or a frame of the object, and in which each of the first and second rows of light sources comprise a plurality of light-emitting diodes.

3. The lighting system for illuminating an object of claim 2 in which the first set of optics includes a first set of diffusers, and the second set of optics includes a second set of diffusers having a smaller angle of diffusion than that of the first set of diffusers.

4. The lighting system for illuminating an object of claim 3 in which the first set of optics includes a first set of reflectors, and the second set of optics includes a second set of reflectors having different reflective optics than that of the first set of reflectors.

5. The lighting system for illuminating an object of claim 4 in which the first set of reflectors are parabolic reflectors, and the second set of reflectors are total internal reflective lenses.

6. The lighting system for illuminating an object of claim 2 in which the first set of optics includes a first set of reflectors, and the second set of optics includes a second set of reflectors having different reflective optics than that of the first set of reflectors.

7. The lighting system for illuminating an object of claim 6 in which the first set of reflectors are parabolic reflectors.

8. The lighting system for illuminating an object of claim 6 in which the second set of reflectors are total internal reflective lenses.

9. The lighting system for illuminating an object of claim 8 in which the first set of reflectors are parabolic reflectors.

10. The lighting system for illuminating an object of claim 2 in which the light sources in each of the first and second rows of light sources are positioned in a longitudinal row, and each of the first and second rows of light sources independently pivot along their longitudinal axes.

11. The lighting system for illuminating an object of claim 10 in which the illumination level of each of the first and second rows of light sources may be adjusted.

12. A process for illuminating an object comprising the steps of:

generating light by a first row of light sources having a plurality of light sources;

generating light by a second row of light sources having a plurality of light sources;

projecting the light from the first row of light sources through a first set of optics towards a first portion of the viewing side of the object; and projecting the light from the second row of light sources through a second set of optics towards a second portion of the viewing side of the object that is farther away from the first and second rows of light sources than that of the first portion of the viewing side of the object;

wherein the first set of optics has different optical properties than that of the second set of optics;

wherein the first and second rows of light sources are positioned outside the line of sight of the viewing side of the object; and wherein the light that passes through the first and second set of optics is scattered such that the first and second portions of the viewing side of the object are illuminated substantially uniformly.

13. The process for illuminating an object of claim 12 in which the first set of optics diffuses the light through a first diffusing film, and the second set of optics diffuses the lights through a second diffusing film that has a smaller angle of diffusion than that of the first set of diffusing film.

14. The process for illuminating an object of claim 13 in which the first set of optics reflects the light through a first set of reflectors, and the second set of optics reflects the light through a second set of reflectors that have different optical properties of reflection than that of the first set of reflectors.

15. The process for illuminating an object of claim 14 further comprising the steps of:

securing the first and second rows of light sources to the object or a frame of the object;

independently pivoting the first and second rows of light sources along their longitudinal axes to direct the light generated by the each of the first and second rows of light sources onto the first and second portions, respectively; and independently adjusting the illumination intensity of each of the first and second rows of light sources.

16. The process for illuminating an object of claim 12 in which the first set of optics reflects the light through a first set of reflectors, and the second set of optics reflects the light through a second set of reflectors that have different optical properties of reflection than that of the first set of reflectors.

17. The process for illuminating an object of claim 16 in which the first set of reflectors are parabolic reflectors.

18. The process for illuminating an object of claim 16 in which the second set of reflectors are total internal reflective lenses.

19. The process for illuminating an object of claim 18 in which the first set of reflectors are parabolic reflectors.

20. The process for illuminating an object of claim 12 further comprising the step of securing the first and second rows of light sources to the object.

* * * * *